US005429301A

United States Patent [19]

Franks

[11] Patent Number: 5,429,301

[45] Date of Patent: Jul. 4, 1995

[54] PERSONAL DEFENSE DEVICE AND METHOD

[76] Inventor: H. Trent Franks, 7726 N. 30th Dr., Phoenix, Ariz. 85051

[21] Appl. No.: 132,377

[22] Filed: Oct. 6, 1993

[51] Int. Cl.[6] ..... B65D 83/14

[52] U.S. Cl. ..... 239/1; 239/154; 239/211; 222/3; 222/78; 222/145.1; 222/175; 222/402.11

[58] Field of Search ..... 222/1, 3, 4, 6, 39, 222/78, 132, 135, 145, 402.11, 175; 239/211, 154, 1

[56] References Cited

U.S. PATENT DOCUMENTS

| | | | |
|---|---|---|---|
| D. 236,817 | 9/1975 | Sweany | D10/106 |
| D. 248,759 | 8/1978 | Eckmann | D14/68 |
| D. 260,008 | 7/1981 | Wistrand | D10/106 |
| D. 275,423 | 9/1984 | Stansbury | D26/38 |
| D. 283,684 | 5/1986 | Francis | D10/106 |
| D. 283,806 | 5/1986 | Harris | D10/106 |
| D. 288,468 | 2/1987 | Ruttinger | D22/117 |
| D. 320,210 | 9/1991 | Mbuthia | D14/168 |
| 3,023,932 | 3/1962 | Hennis et al. | 222/135 X |
| 3,109,253 | 11/1963 | Eig | 42/1 |
| 3,161,322 | 12/1964 | Stone | 222/5 |
| 3,228,656 | 1/1966 | Stanzel | 222/82 |
| 3,236,418 | 2/1966 | Dalle et al. | 222/145 X |
| 3,635,372 | 1/1972 | Van Dyck et al. | 222/3 |
| 3,638,836 | 2/1972 | Vickers | 222/113 |
| 3,756,467 | 9/1973 | Anketell | 222/78 |
| 3,794,791 | 2/1974 | Thomson | 200/61.93 |
| 4,058,237 | 11/1977 | Luke | 222/78 |
| 4,061,249 | 12/1977 | Smith | 222/78 |
| 4,189,721 | 2/1980 | Doell | 340/539 |
| 4,220,263 | 9/1980 | Caruso | 222/183 |
| 4,223,804 | 9/1980 | Morris | 222/3 |
| 4,241,850 | 12/1980 | Speer | 222/78 X |
| 4,275,820 | 6/1981 | LeBlond | 222/3 |
| 4,308,976 | 1/1982 | Speer | 222/78 |
| 4,446,990 | 5/1984 | Stevenson | 222/82 |
| 4,582,228 | 4/1986 | Diamond et al. | 222/402.11 X |
| 4,633,232 | 12/1986 | Nelson | 340/542 |
| 4,703,402 | 10/1987 | Hsieh | 362/102 |
| 4,716,402 | 12/1987 | Francis | 340/693 |
| 4,719,454 | 1/1988 | Hopkins | 340/574 |
| 4,773,562 | 9/1988 | Gueret | 222/145 X |
| 5,032,824 | 7/1991 | Corbin | 340/574 |
| 5,075,671 | 12/1991 | Livingston, III | 340/574 |
| 5,086,377 | 2/1992 | Roberts | 362/102 |
| 5,088,624 | 2/1992 | Hackett et al. | 222/78 |
| 5,169,029 | 12/1992 | Behar et al. | 222/145 X |

*Primary Examiner*—Andres Kashnikow
*Assistant Examiner*—Lisa Douglas
*Attorney, Agent, or Firm*—Charles E. Cates

[57] ABSTRACT

A personal protection device having a size, configuration and appearance simulating a telephone pager or beeper but having the capability of emitting an incapacitating chemical spray in the event of an attack on the person. The device contains multiple canisters of compressed gas containing the chemical and a movable manifold unit which can be pressed to release a chemical stream from each of the canisters and at the same time integrate the streams to provide a single, forceful spray of debilitating chemical. The device in one embodiment also incorporates a high decibel alarm system to be used in conjunction with the chemical spray.

9 Claims, 2 Drawing Sheets

PERSONAL DEFENSE DEVICE AND METHOD

FIELD OF THE INVENTION

This invention relates to a personal protection device having a size, configuration and appearance in simulation of a telephone pager but having the capability of emitting an incapacitating chemical spray in the event of an attack on the person. The device also incorporates a high decibel alarm system to be used in conjunction with the chemical spray. The invention further includes methods for protecting against assault by assailants.

BACKGROUND OF THE INVENTION

It is a well known statistic that crimes against persons have increased dramatically in recent years. There is a recognized need for means by which individuals can arm themselves against personal attack, using less than deadly repulsive force. In an endeavor to satisfy this need, tear gas products are offered commercially under the trade designation "MACE". Other similar products such as pepper gas are also available. These items are packaged in the form of bulky and unsightly aerosol cans which normally, if used, are carried in a purse or in the glove compartment of a car. While some peace of mind is usually gained by this, a very significant problem still exists. In an emergency situation there usually is not enough time to reach into a purse or glove compartment for a tear gas canister. Since most individuals, outside of law enforcement, are uncomfortable with the awkwardness of carrying a tear gas canister in their hand or on their belt, the chances of being able to defend themselves in an actual emergency situation are dramatically reduced.

There is a consuming need for a tear gas or pepper gas delivery device which can be carried on the person, in a place where it does not cause awkwardness or embarrassment but is still instantly accessible at all times.

It is the object of the present invention to provide a device and method for overcoming the above-mentioned problems associated with the use of non-lethal sprays for protection against personal attacks.

It is a further object of the invention to provide a specially designed device which can be worn comfortably and without embarrassment on the person, in a place where it is instantly accessible to deliver a highly effective spray pattern of non-lethal but debilitating gas, with a maximum range, volume and duration.

It is a still further object to provide a device which can not only produce an incapacitating spray of tear gas, pepper gas, or the like, but also sound an ear-piercing alarm to assist in warding off or discouraging attack by an intruder.

Other objects and advantages of the invention will become apparent as the specification proceeds.

SUMMARY OF THE INVENTION

The present invention is based on the concept of providing a tear gas or pepper gas emitting device which is disguised as a telephone pager or "beeper". As such, the device can be worn comfortably and without embarrassment on a person's belt or on a purse or any other place where one would wear a common pager. In this form, the purpose of the device is disguised, but it is instantaneously available for use in an emergency, to spray incapacitating chemical and/or to emit a high decibel warning alarm.

A problem to be overcome in the development of the present invention is the fact that the large pepper or tear gas canisters (such as the police units) which are available on the market are far too large to disguise effectively as a pager or other small electronic device. Although smaller aerosol units (such as carried on a key chain) are available in ½ ounce or ¼ ounce sizes, these units produce a spray of very limited range, volume and duration. To overcome this problem, the present invention includes a unique manifold system which makes it possible to use the smaller aerosol units in tandem or in triplicate, to produce a device which has the same size and configuration as a telephone pager or beeper but which is capable of dispensing a spray of substantially enhanced range, volume and duration.

Stated in general terms, therefore, the present invention is a personal defense device having a size, configuration and appearance in simulation of a telephone pager, said device comprising a hollow housing; multiple canisters of compressed gas arranged in the housing in axial alignment with each other, said each canisters including a dispensing nozzle adapted for activation upon the inward movement thereof; a manifold unit movably deployed in said housing, with a single outlet orifice communicating with the atmosphere and with multiple inlet orifices individually engaging dispensing nozzles of said canisters; and button means for moving said manifold unit towards said canisters to activate said nozzles, thereby simultaneously dispensing compressed gas from said canisters in an integrated flow through said manifold unit and into the atmosphere through said outlet orifice.

In the development of the invention, it has been found that, with the deployment of the multiple canisters and the movable manifold unit within the housing, there is still space for inclusion of a high decibel alarm unit and the battery for powering it, and accordingly this combination embodiment is included as part of the invention.

The invention also relates to a method of defending against an attacker by utilizing the device described above.

BRIEF DESCRIPTION OF THE DRAWINGS

The objects, features and advantages of the invention will be apparent to those skilled in the art from the following detailed description, taken together with the accompanying drawings, in which.

DETAILED DESCRIPTION OF THE INVENTION

Figure 1:
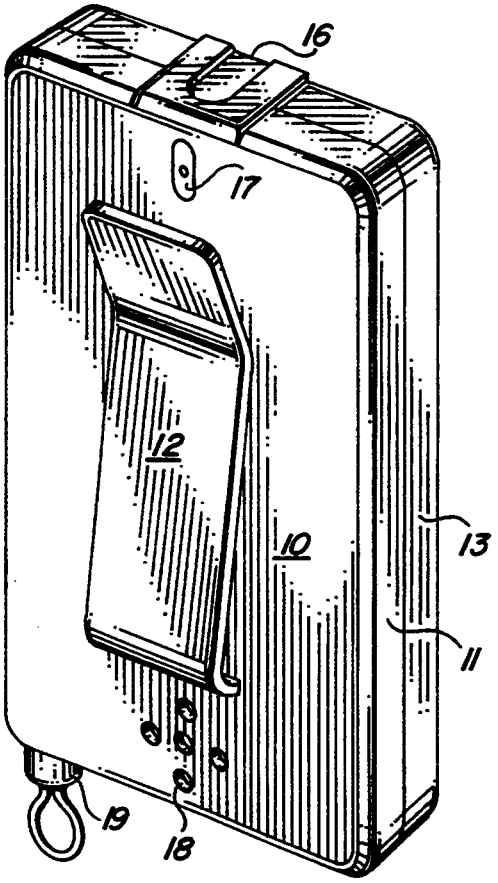
FIG. 1 is a perspective view of the personal defense device of the present invention, showing the simulation of the appearance of a telephone pager.

Referring to the drawings, the device of the invention is shown in FIG. 1 as a simulated telephone pager or "beeper". It comprises a hollow housing 10 made up of a back cover 11, carrying a metal belt clip 12, and a front cover 13, carrying a safety slide button 14 (see FIG. 3). To add to the disguise, a non-functional liquid crystal display panel 15 is included in an end wall (see FIG. 4). The housing may be constructed of various materials, and preferably a durable, moldable, impact-resistant plastic material such as polypropylene or polycarbonate is employed. The device may be of any suitable size, although the objective of disguising it as a telephone pager dictates a very small, compact configuration. In the embodiment shown in FIGS. 1–7, the device measures 4½" long, 2½" wide, and 1⅛" thick. In the embodiment shown in FIG. 8, the device measures 3⅛" long, 2⅛" wide, and 1-3/16" thick.

The device may be worn on the person, using the belt clip 12 or Velcro (not shown) to attach to the belt, or to a purse, or an automobile sun visor, where it is immediately available at all times. In case of an attack on the person, an incapacitating chemical can be sprayed in the attacker's face by sliding the safety button 14 and pressing the spray button 16 to cause a spray to emit from outlet orifice 17. Concurrently, a high decibel alarm can be sounded through apertures 18 by pulling the pin 19.

Figure 2:
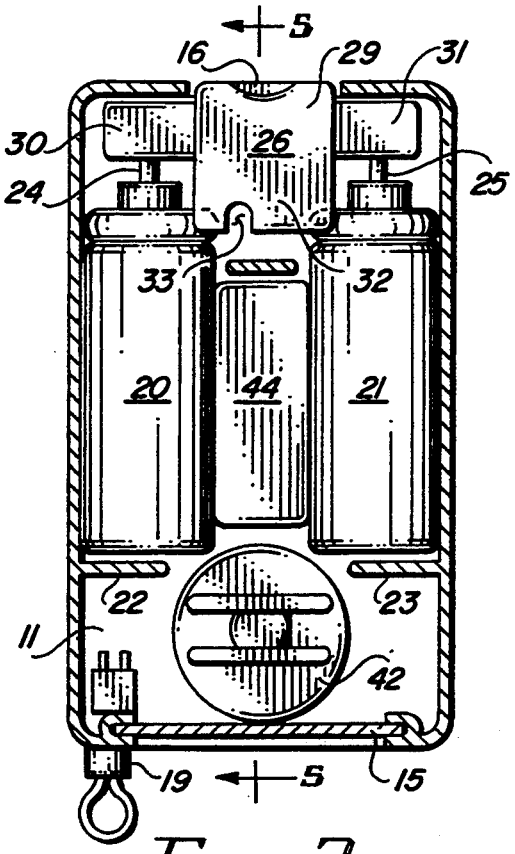
FIG. 2 is an elevational view of the device, with the cover and some of the alarm components removed, showing the positioning of the spray components and the movable manifold unit.

The spray components of the device of the present invention are best shown in FIGS. 2, 5, 6 and 7. Referring to FIG. 2, dual aerosol spray canisters 20 and 21 are deployed in the housing 11, in side-by-side alignment with each other, and supported by rails 22 and 23 which are formed as part of the housing 11. In the embodiment shown in these figures, the canisters are standard aerosol containers containing an incapacitating chemical and having nozzles 24 and 25 which are activated to spray their contents by pushing the nozzles inwardly. In their standard construction, these nozzles have built-in spring means (not shown) which normally urge the nozzles toward the outward, closed position, but which may be compressed by inward pressure to release compressed gas and chemical from the canisters in the form of a spray.

The incapacitating chemical may be any suitable, known substance which may be used with an aerosol or other propellant means to produce a disabling stream or spray. A 5% capsicum oleoresin (pepper gas) solution has been found to be most effective and is preferred. However, tear gas, MACE and other noxious chemicals are also included in the category of non-lethal substances which may be used in the invention.

The spray canisters 20 and 21 are preferably standard ½ ounce tubular aluminum aerosol cans such as provided by the Peerless Corp., of Bloomfield, N.J., with a valve known as an S-20T continuous spray valve, such as furnished by Emson Research, of Bridgeport, Conn. Smaller canisters with ¼ ounce contents are also standard items on the market and are useful in the invention. Other shapes of cans are not available as standard designs, and the cost of obtaining them would detract from their usefulness for the present purpose.

Figure 3:
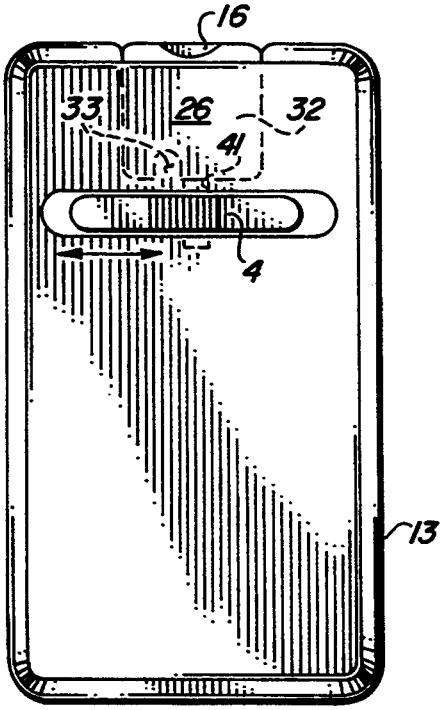
FIG. 3 is an elevational view of the cover panel carrying the safety slide.
Figure 4:
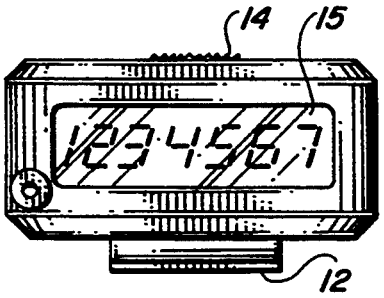
FIG. 4 is an end view of the device, showing the simulation of the liquid crystal display normally present on a telephone pager.
Figure 5:
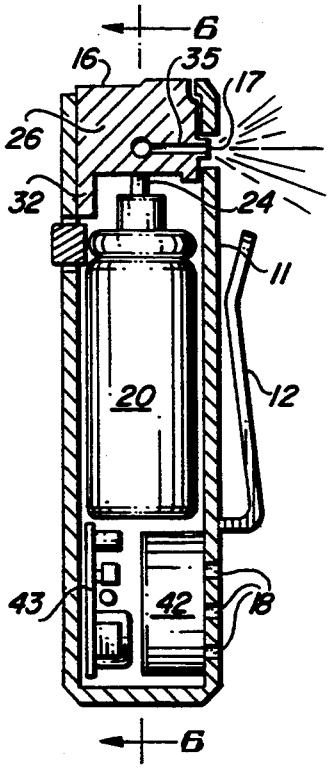
FIG. 5 is a cross-sectional view of the device, taken along line 5—5 of FIG. 2.

A feature of the invention is a dual-purpose manifold unit which not only serves to integrate the sprays from multiple canisters into a single enhanced stream but also serves as the push button for activating the spray. As shown in FIGS. 2, 3 and 5, and in enlarged detail in FIGS. 6 and 7, manifold unit 26 is movably deployed in the housing 10 with a single outlet orifice 17 communicating with the atmosphere and with multiple inlet orifices 27 and 28 individually engaging the dispensing nozzles 24 and 25 of canisters 20 and 21, respectively.

The manifold unit 26 comprises a main body element 29, with horizontal arms 30 and 31, and with a depending flat extension 32, which serves to stabilize the movement of the manifold 26 and also provides a notch 33, which is used in conjunction with the slide button 14 to lock or unlock the movement of the manifold, as will be described hereinafter in greater detail. On the interior of the manifold 26 is a manifold passage 34 which connects with inlet orifice 27 at one end and with inlet orifice 28 at the other end. The passage 34 also makes a T connection with extension 35 at the junction 36. The extension 35 terminates in the outlet orifice 17.

Figure 6:
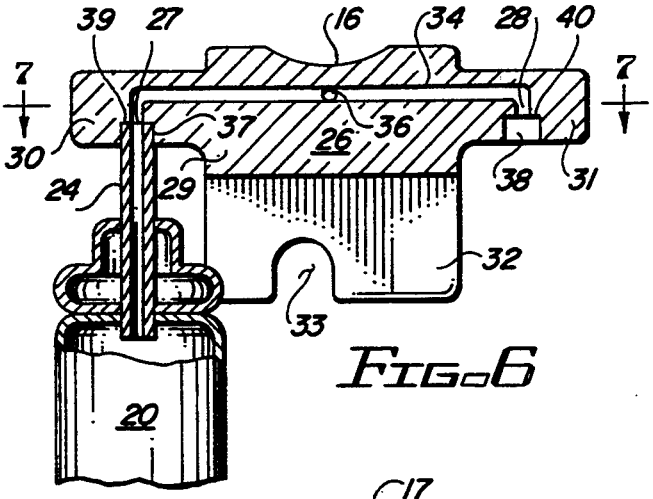
FIG. 6 is a cross-sectional view of the manifold unit, taken along line 6—6 of FIG. 5.
Figure 7:
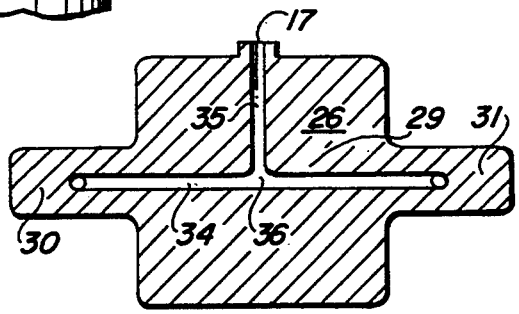
FIG. 7 is another cross-sectional view of the manifold unit, taken along line 7—7 of FIG. 6.

As shown in FIG. 2, the nozzle 24 of canister 20 is engaged by the bottom of arm 30 of the manifold unit 26, and the nozzle 25 of canister 21 is engaged by the bottom of arm 31. FIG. 6 shows this engagement in enlarged detail, with canister 20 pictured in place but with canister 21 omitted from the drawing, to better show the detail of the bottom part of arm 31. At the inlet orifice 27, there is an enlarged opening 37 in the bottom of arm 30. A similar enlarged opening 38 in the bottom of arm 31 is shown more clearly, due to the absence of canister 21 and its nozzle 24 from FIG. 6. The enlargement of the openings 37 and 38 provides shoulders 39 and 40 against which the ends of nozzles 24 and 25 abut when they are placed in operative position within the device.

In operation of the device, when finger pressure is exerted on the button surface 16 of the manifold unit 26 to move the unit downwardly, the shoulders 39 and 40 serve as contact surfaces for engaging the dispensing nozzles 24 and 25 to produce inward articulation of the nozzles, thereby dispensing a stream of compressed gas from each of the canisters 20 and 21. The streams thus released enter manifold passage 34 simultaneously through inlet orifices 27 and 28 and proceed to the junction 36 where they are combined into a single stream in extension 35 and carried to the outlet orifice 17, where a spray is dispensed into the atmosphere. When finger pressure on the manifold button 16 is released, the springs built into the nozzles 24 and 25 urge the manifold unit back to the closed position, and the spray ceases.

As best shown in FIG. 3, the manifold unit 26 has a depending flat extension 32, which is provided with a notch 33 on its lower edge. This arrangement is used in conjunction with the slide button 14, which is built into the cover 13, and which may be moved to the right or to the left, to lock or unlock the movement of the manifold. The slide button is fitted with an abutment 41, and in the locked condition, this abutment is located in the position shown in FIG. 3, where its contact with the lower edge of manifold extension 32 prevents the manifold 26 from being moved downwardly. To activate the device, the button 14 is moved to the left, so that the abutment 41 registers with the notch 33, thus permitting free downward movement of the manifold 26.

The combining of streams in the manner described above, utilizing the movable manifold unit of the present invention, causes a spray of substantially enhanced character, in terms of range, pattern, volume and duration. For example, a single ½ ounce canister of pepper gas provides a spray having a range of only about 4 to 6 feet, which has limited effectiveness as a weapon of defense. With dual ½ ounce canisters in tandem, as in the present invention, it has been found that the range is extended by at least 70% to a distance of 8 to 10 feet, providing a double dose of chemical without suffering any decrease in the volume. Further enhancements can be obtained by use of three or more canisters, although, if the objective is to maintain the disguise of a telephone pager, there is a size limitation on the number of units used.

The design of the manifold of the present invention overcomes one of the basic problems common to tear gas and pepper gas spray units, which is insufficient flow of spray material due to inherent restriction across the valve mechanism within the actual canister containing the gas. The manifold of the present invention overcomes these problems by enabling careful calibration of the relative sizes of the flow passages and orifices in the manifold unit 26. The ultimate goal in mind is that of achieving nozzle pressure at the outlet orifice 17 roughly equivalent to canister pressure flowing through the largest emission bore possible. When the orifice size and passage bore are thusly calibrated to utilize the greater flow provided by multiple canisters while simultaneously maintaining maximum back pressure at the outlet orifice, the result is a spray pattern with maximum volume and maximum retained inertia, and consequently a much greater duration and range than other comparably sized spray units. To otherwise achieve such range, volume and duration, one would be forced to use a large single canister unit (such as the police units) which would be far too large to disguise effectively as a pager or other small electronic device.

In the manifold of the present invention, utilizing two ½ ounce canisters of compressed gas, it has been found that maximum performance can be obtained if the inlet orifices 27 and 28 are from about 0.09 to 0.11" in diameter, the internal passage or conduit 34 is about 0.11 to 0.13" in diameter, and the outlet orifice is about 0.055 to 0.065" in diameter. The preferred sizes are 0.10" for the inlet orifices, 0.12" for the internal passage, and 0.06" for the outlet orifice.

Figure 8:
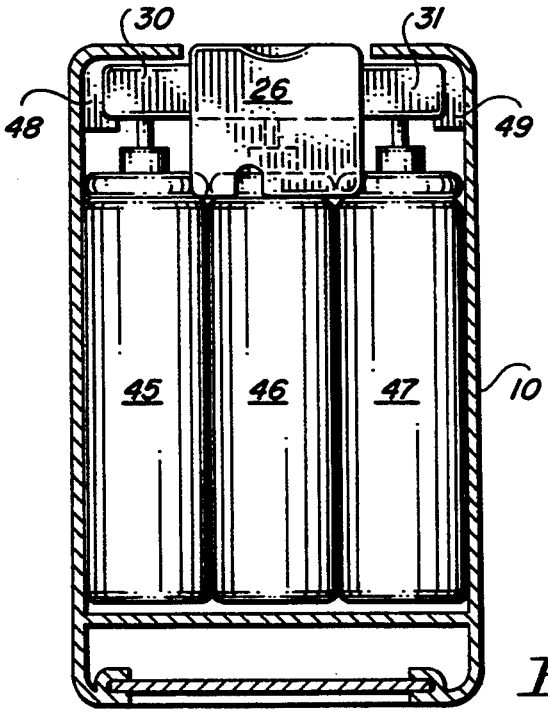
FIG. 8 is a cross sectional view of the device, similar to FIG. 5, but showing an embodiment in which the alarm has been replaced with a third aerosol canister.

When three ¼ ounce canisters of compressed gas are used, as shown in FIG. 8, it has been found that maximum performance can be obtained if the inlet orifices are from about 0.09 to 0.11" in diameter, the internal passage or conduit 34 is about 0.11 to 0.13" in diameter, and the outlet orifice is about 0.035 to 0.045" in diameter. The preferred sizes are 0.10" for the inlet orifices, 0.12" for the internal passage, and 0.04" for the outlet orifice.

The present invention also contemplates the feature of including a high decibel alarm unit within the housing 10. As shown best in FIGS. 2 and 5, the alarm feature comprises a piezo sounder 42 with a capacity of 70 decibels or more; a circuit board 43; a standard pin switch 19; and a battery 44. These are standard items of commerce, available from such sources as G. C. Thorsen, Inc., of Rockford, Ill. (for the piezo sounder); and Keystone Electronics Corp., of Astoria, N.Y. (for the pin switch and circuit board). In the arrangement shown, any suitable 9 volt battery will be effective for powering the alarm system. The alarm is activated merely by pulling the pin switch 19 to supplement the defensive action of the spray device, or to precede it if the circumstances warrant.

FIG. 8 shows an embodiment of the invention in which three ¼ ounce canisters 45, 46 and 47 of compressed gas are deployed in the housing and engaged by a manifold unit 26, which has been modified to provide three inlet orifices for integration of the streams issuing from the three canisters. The device of FIG. 8 also includes rails 48 and 49 which are embedded in the walls of the housing 10 and which register with grooves (not shown) in the ends of manifold arms 30 and 31 respectively. The rail and groove arrangement guides the movement of the manifold unit towards the compressed gas canisters and serves to equalize the discharge of compressed gas from the canisters.

In all other respects, the embodiment of FIG. 8 operates in the same manner as described above in connection with FIGS. 2 through 7, but the use of smaller canisters and the omission of the alarm system components produces a substantially smaller unit which nevertheless provides a spray substantially similar in range to the two-canister embodiment described above.

The device and method of the present invention provide the following features which are significantly advantageous in terms of effectiveness, ease of use, and economy of production:

1. The device overcomes the major problem associated with prior art versions of tear gas or pepper gas units—namely, the inaccessibility of the prior devices. Units which are carried inside purses or glove departments many times cannot be reached in time to serve their purpose. The present device is instantaneously accessible at most times, and its ergonomic design and placement allows it to be accessed and fired in one natural, instinctive, and fluid motion.
2. Many persons are uncomfortable for reasons of social grace in carrying tear gas units resembling those carried by the police or military. The present device, disguised as a telephone pager, is sociably acceptable.
3. Although small enough to pass as a telephone pager, the device is equal to some of the larger police units in terms of range, volume, force and duration of spray.
4. The central feature of the device is a single piece manifold unit which serves the dual purpose of integrating the multiple streams of spray material into a single, forceful spray, while at the same time serving as the actuating button which sets off the spray.
5. The device is simple in design and economic to manufacture. It has a minimum of moving parts. The novel manifold unit is movable but has no moving parts of its own, relying on the spring built into the canister nozzle to supply the motive force.
6. The unit is easily refillable with standard tear gas or pepper gas canisters readily available on the market.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed is:

1. A method of defending against an attacker comprising the steps of:

a. providing a hollow housing having a size, configuration and appearance in simulation of a telephone pager;

b. deploying in said housing multiple canisters, each of which contains like combinations of compressed gas and incapacitating chemical adapted to be dispensed as a spray through a spray outlet in said housing;

c. aiming said spray outlet in the direction of said attacker and dispensing a dose of compressed gas and incapacitating chemical simultaneously from each of said canisters into a manifold through inlet orifices about 0.075 to 0.11" in diameter;

d. causing said doses to be collected and integrated in said manifold in an interior passage thereof which is about 0.11 to 0.13" in diameter; and e. dispensing said integrated doses from said interior passage through a manifold outlet orifice about 0.035 to 0.065" in diameter;

whereby said combination of compressed gas and incapacitating chemical from each canister is dispensed into the atmosphere in the direction of said attacker in an integrated multiple dose spray having a spray range of at least 8 to 10 feet.

2. A personal defense device adapted to be attached to the user's person, comprising:

a. a hollow housing having a size, configuration and appearance in simulation of a telephone pager;

b. multiple canisters received on the interior of said housing in side-by-side relation, each of said canisters including a dispensing nozzle adapted for activation upon the inward movement thereof, and each of said canisters containing like combinations of compressed gas and incapacitating chemical adapted to be dispensed as a spray; and c. a manifold unit movably deployed in said housing, with a single outlet orifice about 0.035 to 0.065" in diameter communicating with the atmosphere, with multiple inlet orifices about 0.075 to 0.11" in diameter individually engaging respective dispensing nozzles of said canisters, with an interior manifold passage about 0.11 to 0.13" in diameter, and with button means for moving said manifold unit towards said canisters to activate said nozzles;

whereby manual pressure on said button means causes simultaneous inward articulation of each of said nozzles in said canisters, thereby simultaneously dispensing a combination of compressed gas and incapacitating chemical from each canister in an integrated flow through said manifold unit and into the atmosphere through said outlet orifice in a multiple dose spray having a spray range of at least 8 to 10 feet.

3. The device of claim 2 wherein said canisters of compressed gas contain oleoresin capsicum.

4. The device of claim 2 wherein the interior walls of said housing are provided with guide means for stabilizing the movement of said manifold unit towards said compressed gas containers, to equilize the discharge of compressed gas from said canisters.

5. The device of claim 4 wherein said guide means comprise rails on the interior walls of said housing, which register with slots in adjacent surfaces of said manifold unit.

6. The device of claim 2 wherein said multiple canisters comprise two containers carrying about ½ ounce each of incapacitating spray material and wherein the said manifold unit has inlet orifices about 0.09 to 0.11" in diameter, an outlet orifice about 0.055 to 0.065" in diameter, and an interior manifold passage about 0.11 to 0.13" in diameter.

7. The device of claim 2 wherein said multiple canisters comprise three containers carrying about ¼ ounce each of incapacitating spray material and wherein the said manifold unit has inlet orifices about 0.075 to 0.085" in diameter, an outlet orifice about 0.035 to 0.045" in diameter, and an interior manifold passage about 0.11 to 0.13" in diameter.

8. The device of claim 2 further comprising an electronic alarm unit stored on the interior of said housing and also battery means positioned therein to provide power for said alarm unit.

9. The device of claim 1 further comprising a safety slide carried by said housing and manually shiftable relative to the housing to and from a first position wherein said manifold unit is locked in an inoperative condition and a second position wherein said manifold unit may be moved by manual pressure on said button means to dispense compressed gas from said canisters.

* * * * *

UNITED STATES PATENT AND TRADEMARK OFFICE

CERTIFICATE OF CORRECTION

PATENT NO. : 5,429,301

DATED : July 4, 1995

INVENTOR(S) : H. Trent Franks

It is certified that error appears in the above-identified patent and that said Letters Patent is hereby corrected as shown below:

Col.8,

Claim 9 is dependent upon claim --2-- instead of claim "1".

Signed and Sealed this

Twelfth Day of September, 1995

*Attest:*

Bruce Lehman

BRUCE LEHMAN

*Attesting Officer*

*Commissioner of Patents and Trademarks*